United States Patent [19]

Sainio

[11] Patent Number: 4,527,640

[45] Date of Patent: Jul. 9, 1985

[54] WORKING PLATFORM FOR A DRILLING APPARATUS

[75] Inventor: Aimo Sainio, Tampere, Finland

[73] Assignee: Oy Tampella Ab, Tampere, Finland

[21] Appl. No.: 527,792

[22] Filed: Aug. 30, 1983

[30] Foreign Application Priority Data

Sep. 16, 1982 [FI] Finland ..... 823203

[51] Int. Cl.[3] ..... E21B 41/00; E21C 5/00

[52] U.S. Cl. ..... 175/86; 299/70; 173/43

[58] Field of Search ..... 175/86, 219; 299/70, 299/36; 173/42, 43; 405/148

[56] References Cited

FOREIGN PATENT DOCUMENTS 532683 8/1975 U.S.S.R. ..... 405/148

630413 9/1978 U.S.S.R. ..... 299/70

*Primary Examiner*—Stephen J. Novosad

*Assistant Examiner*—Thuy M. Bui

*Attorney, Agent, or Firm*—Ladas & Parry

[57] ABSTRACT

A working platform for a drilling apparatus for stoping shafts, said drilling apparatus comprising a base (3) displaceable in the direction of the shaft (1) and a supporting arm (5) pivotably supported on said base. On the supporting arm is mounted a drilling device (8). The working platform (10) is fastened to the supporting arm by means of an articulated means (11) which permits a pivoting of the working platform with respect to the supporting arm around two pivot axes (B, C) perpendicular to each other so that the working platform pivots synchronously along with the drilling device as the supporting arm is rotated for drilling holes in the shaft in the shape of a fan and is adjustable into a horizontal position irrespective of the rotary position of the supporting arm.

8 Claims, 8 Drawing Figures

Figure 7:
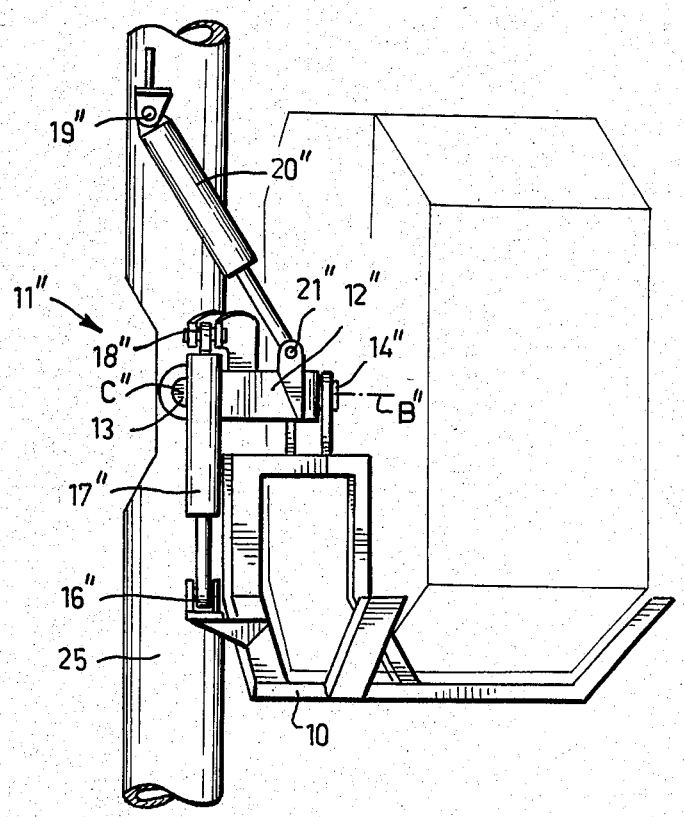

FIG. 1
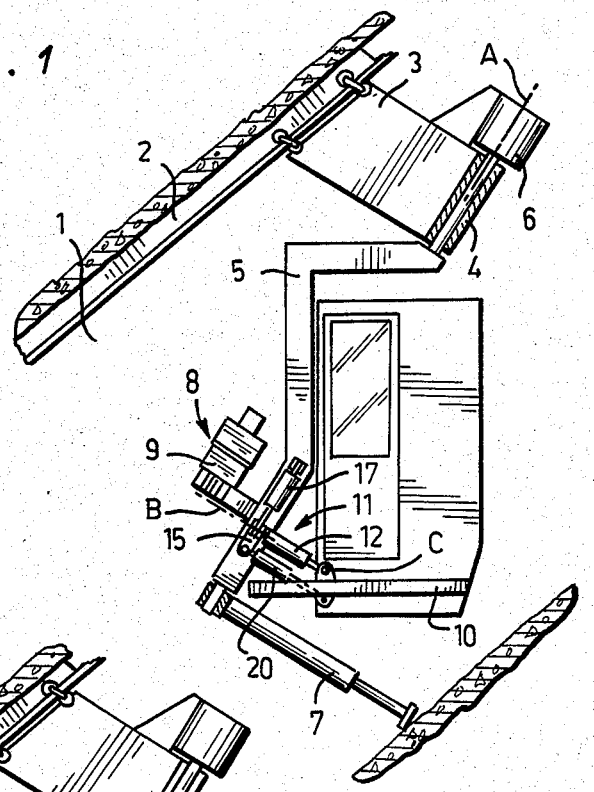
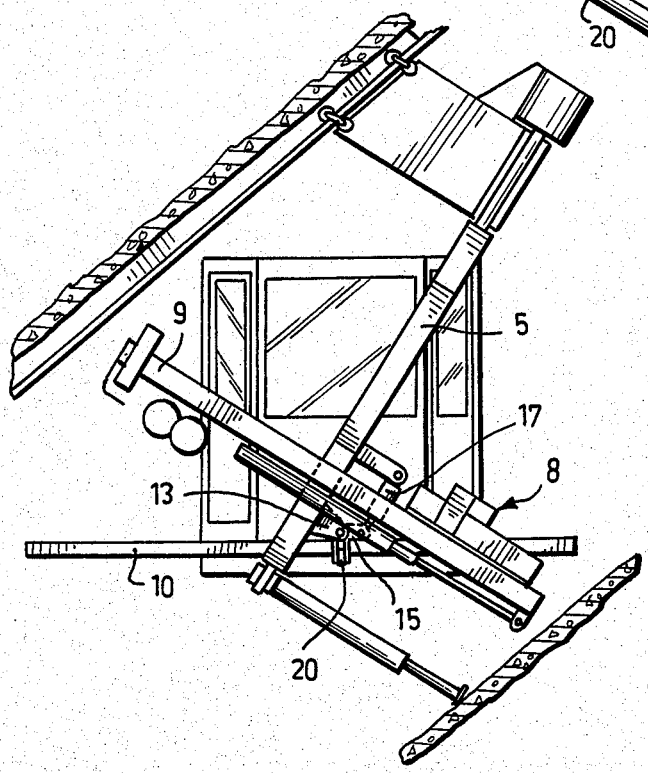
FIG. 2

FIG. 3
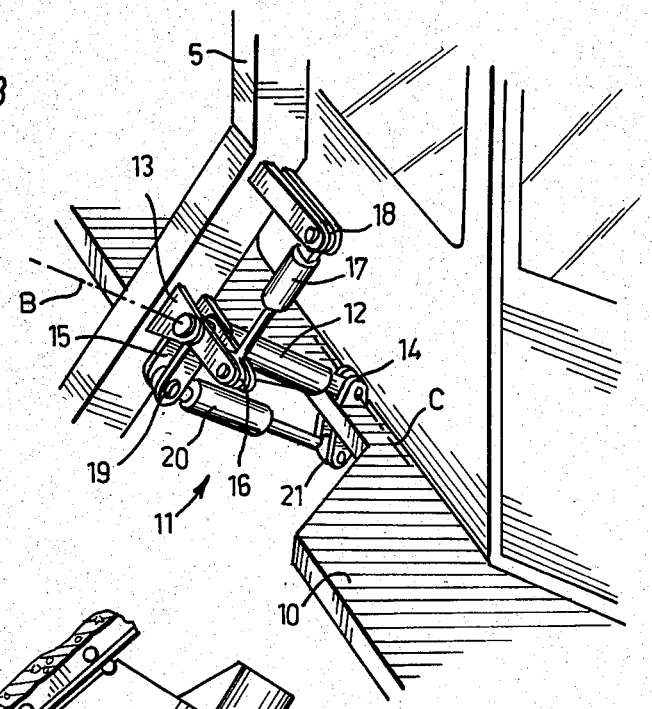
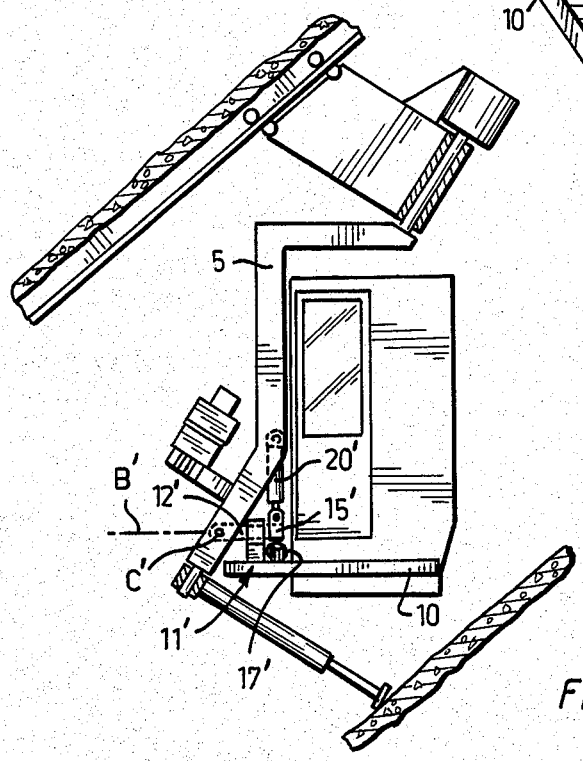
FIG. 4

FIG. 5
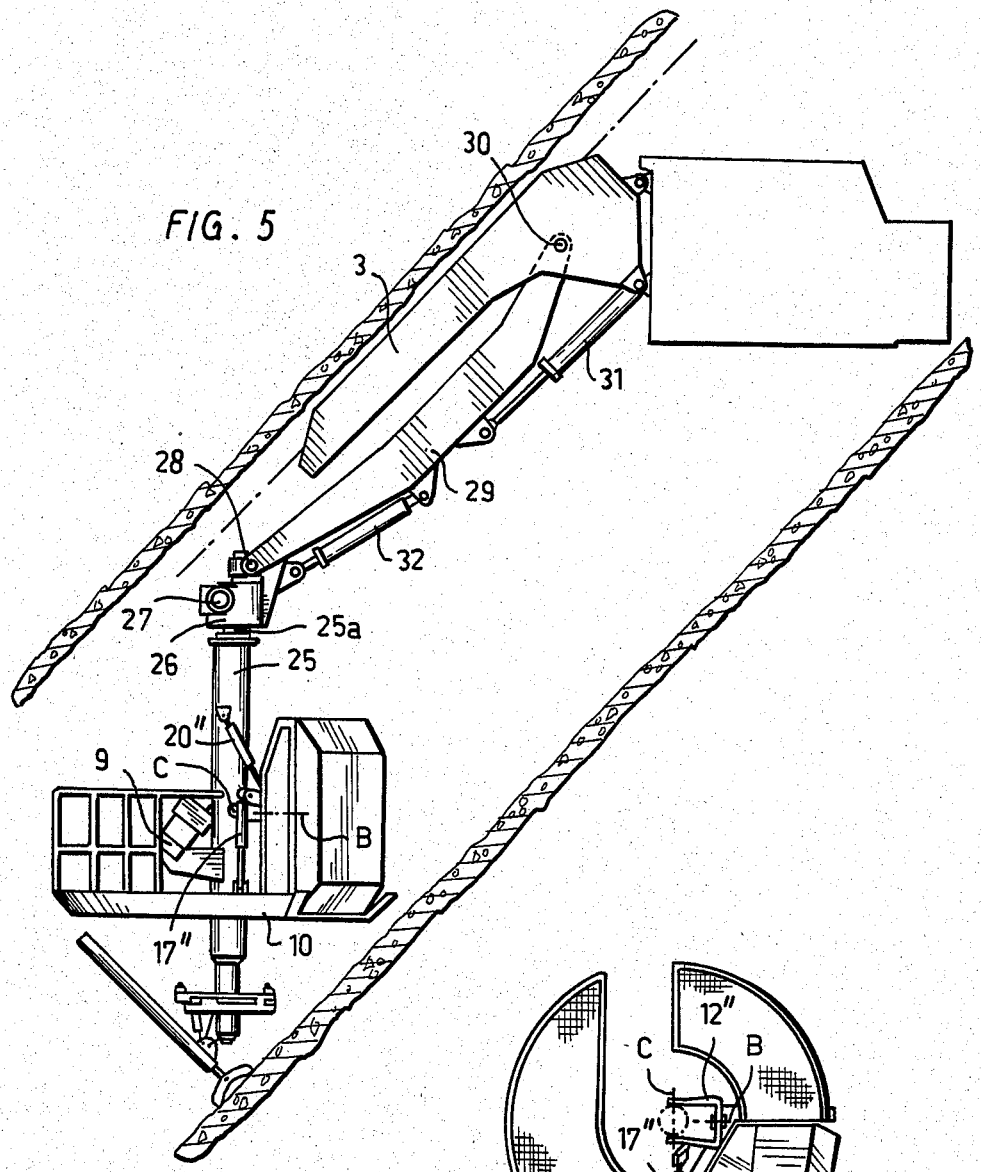
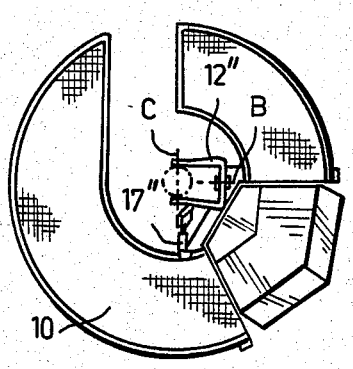
FIG. 6

WORKING PLATFORM FOR A DRILLING APPARATUS

The present invention relates to a working platform for a drilling apparatus for stoping of shafts, said drilling apparatus comprising a base displaceable in the direction of the shaft, a supporting arm pivotably supported on said base, a drilling device mounted on said supporting arm, and a working platform pivotably mounted with respect to said base.

In connection with drilling apparatuses for stoping shafts a working platform has commonly been used which is fastened horizontally to a base or a supporting arm. The drilling device or devices are in this case fastened pivotably on the supporting arm or the working platform whereby the pivot axes of the drilling devices may in addition be tiltable with respect to the working platform.

The Finnish patent application No. 770,330 and the Swedish Published Specification No. 326,679 describe drilling apparatuses in which a base supported against the walls of a shaft forms a working platform for a plurality of drilling devices which are pivotably mounted on a supporting arm which forms a vertical central post rigidly secured to the base.

One disadvantage in such constructions is the large space required. In addition, it is impossible to mount a fixed control cabin or control panel in such constructions because of the pivoting space required by the drilling device. In order to be able to control the drilling location and the operation of the drilling device it is important that a good view is provided from the control location over the drilling device in each of its positions and that the control location is at a level suitable for carrying out maintenance works adjacent to the drilling device.

The Swedish Published Specification No. 346,828 discloses a drilling apparatus in which a base supports a working platform which is mounted pivotably around a horizontal axis so that the working platform is adjustable into a horizontal position irrespective of the inclination of the shaft and the base. The drilling device is in this case fastened on the base, and the apparatus is primarily adapted only for drilling in the axial direction of the shaft.

When shafts are stoped by utilizing so-called drilling fans, the high drilling precision required by the fans necessitates a sturdy drilling equipment. From the U.S. Pat. No. 3,746,104 is known a drilling apparatus in which a supporting arm is pivotably mounted on a base. The drilling machine is fastened on said supporting arm for pivoting along with said arm around the axis of rotation thereof. With such a drilling equipment it is possible to drill precise drilling fans, but the utilization of a construction of this type in stoping inclined shafts is hampered by the arrangement of a working platform in the drilling apparatus.

The object of the present invention is to provide a working platform which is suitable for mounting also in a drilling apparatus of the last-mentioned type when using said apparatus for stoping inclined shafts. This object is achieved by means of a working platform according to the invention which is characterized in that said working platform is fastened to said supporting arm by means of an articulated means which permits a pivoting of the working platform with respect to the supporting arm around two pivot axes perpendicular to each other.

The invention is based on the idea of supporting the working platform on the same supporting arm as the drilling device but through an articulated means so that the working platform is always adjustable into a horizontal position in the different rotary positions of the supporting arm. Because the axis of rotation of the supporting arm in general is inclined, the working platform would tilt due to the rotation if it were fixedly fastened to the supporting arm. Both the drilling device and the working platform pivot simultaneously around the axis of rotation of the supporting arm when the drilling direction is changed, due to which the visibility from the control location to the drilling object and the drilling device always is good. The maintenance of the drilling device is in a corresponding manner easy to carry out because the maintenance plane always is adjacent to the drilling device. By using automatic sensors for the position of the working platform it is possible to keep the working platform automatically in a horizontal position while rotating the drilling device and simultaneously the working platform around the axis of rotation of the supporting arm. The shaft area required for a drilling apparatus provided with a working platform is small because its size is mainly dependant on the length of the feeding beam of the drilling device only. A vibration-damped and noise-protected cabin for the driller can be mounted on the working platform which reduces the health hazards.

Figure 8:
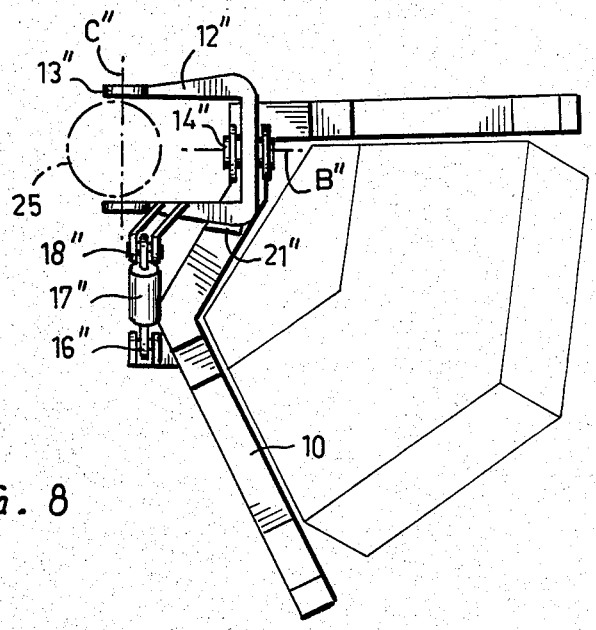

In the following the invention will be described in more detail with reference to the accompanying drawings, in which FIGS. 1 and 2 illustrate a drilling apparatus provided with a working platform according to the invention and mounted in an inclined shaft whereby the feed device is in FIG. 2 turned 90° compared to FIG. 1, FIG. 3 is a perspective view on an enlarged scale of the articulated means of the working platform, FIG. 4 illustrates a second embodiment of the working platform as seen in the same direction as in FIG. 1, FIG. 5 is a side view of the working platform according to the invention mounted in a drilling apparatus of a different construction, FIG. 6 is a top view of the working platform, and FIGS. 7 and 8 are side and top views, respectively, on an enlarged scale of the articulated means illustrated in FIGS. 5 and 6.

In FIGS. 1 to 3 of the drawings reference numeral 1 denotes a shaft to be stoped. A guide 2 parallel with the shaft is fastened to the roof of said shaft. The guide supports a base 3 displaceable along the guide. In a bearing 4 provided in the base is mounted rotatably a supporting arm 5 which is substantially parallel with the shaft and at its upper end is connected to a rotating motor 6 supported by the base. The supporting arm is at its lower end mounted rotatably in support feet 7 by means of which the supporting arm can be supported against the wall of the shaft.

A drilling device 8 is fastened to the supporting arm so that the feeding beam 9 of said device is located perpendicularly to the supporting arm and follows fixedly the rotary movement of the supporting arm around an axis of rotation A. The feeding beam is preferably mounted so that it can perform a pivoting movement in a plane perpendicular to the axis of rotation A.

According to the invention, the supporting arm 5 supports a working platform 10 through an articulated means 11. The articulated means comprises a bracket 12 which at one end is mounted in bearing lugs 13 fastened to the supporting arm pivotally around a first pivot axis B which is located perpendicularly to the axis of rotation A of the supporting arm 5. The bracket is at the other end mounted in bearing lugs 14 fastened to the working platform pivotally around a second pivot axis C which is located perpendicularly to the first pivot axis B in a plane perpendicular to the axis of rotation A.

The articulated means furthermore includes an angle lever 15 mounted in said bearing lugs 13 of the supporting arm pivotally around said first pivot axis B of the supporting arm. One arm of the angle lever is by means of a link 19 connected to a hydraulic cylinder 17 which at one end is connected to the supporting arm by means of a link 18. The other arm of the angle lever is connected by means of a link 19 to a hydraulic cylinder 20 which forms a support arm and which at one end is connected to bearing lugs 21 supported by the working platform pivotally around a pivot axis parallel with said second pivot axis C.

The bracket 12, the supporting arm and the angle lever 15 as well as the links 13-19-21-14 form an articulated parallelogram which supports the working platform on the supporting arm 5. The angle of the working platform with respect to the supporting arm is adjustable by adjusting the length of the hydraulic cylinder 20 forming the support arm. Said articulated parallelogram can be tilted with respect to the supporting arm by adjusting the length of the hydraulic cylinder 17, which pivots the angle lever and thus also the working platform with respect to the supporting arm.

When the supporting arm is rotated, e.g., 90° around the axis of rotation from the position shown in FIG. 1 to the position shown in FIG. 2, the working platform pivots along with the supporting arm. Without the articulated means according to the invention the working platform would assume the same inclined position as the feeding beam of the drilling device in FIG. 2. In order to avoid this, the angle lever 15 is, by shortening the hydraulic cylinder 17, pivoted counterclockwise in FIG. 2 to such an extent that the articulated parallelogram pivots the working platform around the pivot axis B to a horizontal position. In addition, the working platform is preferably pivoted simultaneously around the pivot axis C to such an extent by shortening the hydraulic cylinder 19 that the working platform assumes a horizontal position also as seen in the direction of this axis. The pivoting movement can be simply automatized by using automatic position sensors which actuate the control valves of the hydraulic cylinders of the articulated means. In this way, the working platform pivots along with the drilling device synchronously around the axis of rotation A and, inspite of the pivoting movement, maintains its horizontal position.

FIG. 4 shows a modification of the articulated means in which corresponding parts are denoted with the same reference numerals and letters as in FIG. 3, however, provided with an apostrophe.

FIGS. 5 to 8 illustrate a drilling apparatus in which the supporting arm 25 has a straight axis. The arm is fastened to a cradle 9 of the feed device of the boring machine and by means of an articulated means 11'' a working platform 10 which by means of cylinders 20'' and 17'' is pivotable with respect to axes C'' and B''. The supporting arm is pivotally mounted by means of a shaft 25*a* to a rotating head 26 which is provided with a rotating mechanism 27 and is mounted pivotally by means of a link 28 and an intermediate arm 29. The intermediate arm is mounted pivotally by means of a link 30 to the base 3. The axes of the links 28 and 30 are horizontal. The angular position of the intermediate arm with respect to the base is adjustable by means of a hydraulic cylinder 31 connected between said intermediate arm and the base. The angular position of the rotating head with respect to the intermediate arm is adjustable by means of a hydraulic cylinder 32 connected between said rotating head and the intermediate arm.

The drawings and the description related thereto are only intended to illustrate the idea of the invention. In its details, the working platform according to the invention may vary within the scope of the claims.

What I claim is:

1. A working platform for a drilling apparatus for stoping shafts, said drilling apparatus comprising a base (3) displaceable in the direction of the shaft (1), a supporting arm (5; 25) pivotably supported on said base, a drilling device (8) mounted on said supporting arm, and a working platform (10) pivotably mounted with respect to said base, wherein said working platform (10) is fastened to said supporting arm (5; 25) by means of an articulated means (11) which permits a pivoting of the working platform with respect to the supporting arm around two pivot axes (B, C) perpendicular to each other.

2. A working platform according to claim 1, wherein in that said articulated means (11) comprises a bracket (12) which is mounted on said supporting arm (5; 25) or said working platform (10) pivotably around a first pivot axis (B) and on the working platform or the supporting arm, respectively, pivotably around a second pivot axis (C), and actuating means (17, 20) for pivoting the working platform selectively around said pivot axes.

3. A working platform according to claim 2, wherein in that said bracket (12) is at one end mounted on said supporting arm (5) pivotably around its longitudinal axis (B) and at the other end on the working platform (10) pivotably around a pivot axis (C) substantially parallel with the plane of the working platform, and that said articulated means includes a lever (15) which is mounted on the supporting arm (5) pivotably around the axis (B) of said bracket (12), and a first actuating means (20) which has an adjustable length and is connected between one arm of said lever and said working platform, and a second actuating means (17) which has an adjustable length and is connected between the other arm of said lever and the supporting arm.

4. A working platform according to claim 2, wherein in that said bracket (12') is at one end mounted on said supporting arm (5) pivotably around a pivot axis (C') perpendicular to the supporting arm and the other end mounted on said working platform (10) pivotably around its longitudinal axis (B'), and that said articulated means comprises a lever (15') fastened to said bracket and a first actuating means (20) which has an adjustable length and is connected between one arm of said lever and said supporting arm, and a second actuating means (17') connected between the other arm of said lever and the working platform.

5. A working platform according to claim 2, wherein in that said bracket (12'') is at one end mounted on said supporting arm (25) pivotably around a pivot axis (C'') perpendicular to the supporting arm and at the other end mounted on said working platform pivotably around a pivot axis (B″) substantially parallel with the plane of the working platform, and that said articulated means comprises a first actuating means (20″) which has an adjustable length and is connected between said bracket (12″) and said working platform (10) and a second actuating means (17″) which has an adjustable length and is connected between the bracket (12″) and the supporting arm (25).

6. A working platform according to claim 5, wherein in that said supporting arm (5) is at one end mounted on said base (3) pivotably around an axis substantially parallel with said shaft (1), and that said articulated means (11) is mounted at the other end of the supporting arm.

7. A working platform according to claim 5, wherein in that said supporting arm (25) is at one end mounted on an intermediate arm (29) pivotably around two pivot axes perpendicular to each other, said intermediate arm being mounted on said base (3) pivotably around an axis parallel with said second pivot axis (28), and that said articulated means (11) is mounted at the other end of said supporting arm.

8. A working platform according to claim 1, wherein said drilling device (8) is provided with a feeding beam 9 which is mounted fixedly with respect to said supporting arm (5; 25), preferably in parallel with a plane perpendicular to the axis of the supporting arm.

* * * * *